US005938402A

United States Patent [19]

Bochud et al.

[11] Patent Number: 5,938,402

[45] Date of Patent: Aug. 17, 1999

[54] AXIAL TURBINE OF A TURBOCHARGER

[75] Inventors: Dominique Bochud, Untersiggenthal, Switzerland; Markus Kohling, Lengnau, Germany; Jean-Yves Werro, Spreitenbach, Switzerland

[73] Assignee: Asea Brown Boveri AG, Baden, Switzerland

[21] Appl. No.: 08/986,241

[22] Filed: Dec. 5, 1997

[30] Foreign Application Priority Data

Dec. 11, 1996 [DE] Germany ..... 196 51 318

[51] Int. Cl.[6] ..... F02B 77/04; F01D 25/00

[52] U.S. Cl. ..... 415/117; 415/116; 60/619; 134/169 R; 239/558

[58] Field of Search ..... 415/116, 117; 60/619, 39.33; 134/166 R, 169 R, 22.12, 22.18; 239/556, 558, 559, 561, 567

[56] References Cited

U.S. PATENT DOCUMENTS

| | | | |
|---|---|---|---|
| 3,623,668 | 11/1971 | Freid et al. | 415/116 |
| 3,913,845 | 10/1975 | Tsuji | 239/556 |
| 4,196,020 | 4/1980 | Hornak et al. | 415/116 |
| 4,548,040 | 10/1985 | Miller et al. | 415/117 |
| 5,065,945 | 11/1991 | Vidusek et al. | 239/556 |
| 5,385,014 | 1/1995 | Rathbun | 60/39.33 |

FOREIGN PATENT DOCUMENTS

| | | | |
|---|---|---|---|
| 3515825 | 11/1985 | Germany . | |
| 3220081 | 7/1987 | Germany . | |
| 3724385 | 2/1989 | Germany . | |
| 1214222 | 2/1986 | U.S.S.R. | 239/567 |
| 1667939 | 8/1991 | U.S.S.R. | 239/556 |

*Primary Examiner*—Christopher Verdier
*Attorney, Agent, or Firm*—Burns, Doane, Swecker & Mathis, L.L.P.

[57] ABSTRACT

Improved cleaning of the nozzle ring and the moving blades of the axial turbine of a turbocharger is to provided by a cleaning device. The cleaning device (20) includes only one nozzle (21, 44) having at least one injection opening (24) as well as a cleaning-agent feed line (23). The injection opening (24) is arranged at any point (38) of an imaginary circular area (34), which in turn is defined by a center (33) arranged at a distance A upstream of the inner casing wall (11) as well as by a diameter $d_k$. The center (33) lies on an imaginary parallel area (34) formed at a distance A from the inner casing wall (11). The distance A corresponds to the average diameter of the nozzle ring (8) multiplied by a percentage $P_1$, ($5\% \leqq P_1 \leqq 30\%$). The center (33) lies at an intersection point (36) of the parallel area (35) and die flow line (17) intersecting the latter at right angles. The diameter $d_k$ of the circular area (34) is likewise dependent upon the average diameter of the nozzle ring (8), which is multiplied by a percentage $P_2$ ($0\% \leqq P_2 \leqq 6\%$). The injection opening (24) of the nozzle (21, 44) is oriented at least approximately parallel to the tangential plane (37).

8 Claims, 5 Drawing Sheets

AXIAL TURBINE OF A TURBOCHARGER

BACKGROUND OF THE INVENTION

1. Field of the Invention

The invention relates to the axial turbine of a turbocharger.

2. Discussion of Background

The use of exhaust-gas turbochargers for increasing the output of internal combustion engines is widespread nowadays. Here, the exhaust gases of the internal combustion engine are admitted to the exhaust-gas turbine of the turbocharger and their kinetic energy is used to draw in and compress air for the internal combustion engine. As a function of the actual operating conditions and the composition of the fuels used to drive the internal combustion engine, contamination of the moving blades and of the nozzle ring in the exhaust-gas turbine occurs sooner or later, the nozzle ring being affected to a substantially greater extent. In heavy-oil operation, a contamination layer, the hardness of which depends on the working principle of the internal combustion engine, forms on the nozzle ring. In general, such contamination deposits in the region of the nozzle ring lead to a poorer turbine efficiency and consequently to a reduction in the output of the internal combustion engine. In addition, an increase in the exhaust-gas temperatures in the combustion space occurs, as a result of which both the internal combustion engine and the turbocharger may be thermally overstressed. In the internal combustion engine, in particular damage to or even destruction of the valves may occur.

If a contamination layer is deposited on the nozzle ring and the turbine blades of a turbocharger connected to a four-stroke internal combustion engine, an increase in the pressures and in the rotational speed of the turbocharger can be expected. Consequently, components of both the internal combustion engine and the turbocharger are subjected to higher thermal and mechanical stress, a factor which may likewise lead to the destruction of the relevant components. If the contamination layer is distributed irregularly at the periphery of the moving blades of the turbine wheel, an increase in the unbalance of the rotor occurs, as a result of which the bearing arrangement may also be damaged.

Therefore the nozzle rings and the moving blades of the turbine wheel must be regularly cleaned of the contaminants adhering to them.

DE-A1 35 15 825 discloses a method of and a device for cleaning the moving blades and the nozzle ring of the axial turbine of an exhaust-gas turbocharger having an inner bearing arrangement. The axial turbine has a gas-inlet casing having an outer and an inner casing wall, the latter serving to cover the turbine wheel and the shaft relative to the flow passage. The cleaning device comprises a plurality of water injectors arranged on the gas-inlet casing of the axial turbine and having nozzles, reaching into the flow passage, and a water line. At a certain degree of contamination of the axial turbine, a cleaning requirement is determined via a measuring and analyzing unit. Accordingly, water is injected into the flow passage via the nozzles arranged upstream of the guide vanes. The resulting water droplets are transported by the exhaust-gas flow up to the guide and moving blades respectively of the axial turbine and clean said blades of the adhering contaminants.

However, sufficient cleaning of the stationary guide vanes can only be achieved when the water droplets impinge as fully as possible on these guide vanes on their surface facing the exhaust-gas flow. To this end, the water injectors and the nozzles respectively must be arranged in a uniformly distributed manner over the entire periphery of the axial turbine. Accordingly, a larger number of injectors and nozzles are required, as a result of which such a solution becomes relatively complicated and thus expensive. In addition, the cost required to seal the gas-inlet casing increases with an increasing number of nozzles. A further problem is the arrangement of the nozzles in a region of the flow passage in which a relatively high flow velocity prevails. This results in a flat water jet, which only reaches parts of the guide vanes. Sufficient cleaning is therefore not ensured.

SUMMARY OF THE INVENTION

Accordingly, one object of the invention, in attempting to avoid all these disadvantages, is to provide a novel cleaning device for the nozzle ring and the moving blades of the axial turbine of a turbocharger and to arrange this cleaning device in such a way that an improved cleaning effect is achieved at a reduced cost of construction.

According to the invention a cleaning device comprises only one nozzle having a center axis and at least one injection opening as well as a cleaning-agent feed line. The at least one injection opening is arranged at any point of an imaginary circular area, which in turn is defined by a center located at a distance a upstream of the inner casing wall as well as by a diameter $d_k$. The center of the circular area lies on an imaginary parallel area relative to the inner casing wall. This parallel area is formed at a distance a upstream of the inner casing wall, which distance a is calculated according to the following formula:

$$a = \frac{d_a + d_i}{2} \cdot P_1 \text{ with } 5\% \leq P_1 \leq 30\%,$$

Here, $d_a$ is the outside diameter, $d_i$ is the inside diameter and $P_1$ is the percentage determining the minimum and maximum distance A of the parallel area from the inner casing wall.

Only one of the flow lines of the exhaust-gas-flow, which flow lines can be represented in a gas-inlet casing formed without a nozzle, intersects the parallel area at right angles. An intersection point is thus defined at which the center of the circular area is arranged. A plane runs tangentially to the parallel area through the intersection point. The circular area is formed in this tangential plane. The diameter $d_k$ of the circular area is calculated according to the following formula:

$$d_k = \frac{d_a + d_i}{2} \cdot P_2 \text{ with } 0\% \leq P_2 \leq 6\%,$$

$P_2$ being a percentage influencing the size of the diameter $d_k$. The center axis of the nozzle is arranged perpendicularly to the tangential plane, and the at least one injection opening of the nozzle is oriented at least approximately parallel to the tangential plane.

According to this definition, the nozzle and thus its at least one injection opening are arranged in a region of the flow passage in which both the path of the flow lines and the flow-velocity profile permit a complete spread and therefore a uniform distribution of the cleaning agent over the nozzle ring and the moving blades of the turbine wheel. Compared with the prior art, in which the cleaning agent is certainly likewise injected transversely to the gas flow but into a region of the gas-inlet casing with high exhaust-gas velocity and thus the cleaning-agent jet is constricted, the nozzle ring and the moving blades of the turbine wheel can now be uniformly swept with the cleaning agent over both their periphery and their blade height. An improved cleaning effect is therefore ensured despite the use of only one nozzle.

It is especially advantageous if the nozzle has an injection opening arranged exactly at the center of the circular area and the distance a from the inner casing wall to the parallel area is calculated according to the following formula:

$$a = \frac{d_o + d_i}{2} \cdot P_1 \text{ with } 15\% \leq P_1 \leq 20\%$$

In this arrangement of the nozzle or the injection opening, the flow lines are optimally utilized for the uniform spread of the cleaning agent, for which reason the cleaning of the nozzle ring and the moving blades can be further improved.

It is especially expedient if the nozzle has at least one injection opening on both sides of the tangential plane and at the same distance therefrom. Each injection opening has an injection area, the sum of the injection areas on both sides of the tangential plane being the same size. In addition, the injection openings are arranged so as to overlap one another radially or at least adjoin one another. The distribution of the cleaning agent over both the periphery and the blade height of the nozzle ring can thereby be further improved. In addition, such nozzles are more cost-effective and have a longer service life than nozzles having only one injection opening.

Furthermore, it is advantageous if the cleaning-agent feed line consists of two line sections, a fastening element for the first line section adjoining from outside is arranged on the outer casing wall, and the second line section is formed in the interior of the gas-inlet casing.

On account of this design, the gas-inlet casing, of either axial or radial design, including the nozzle and the second line section, can be completely assembled. The attachment of the first line section, i.e. the entire assembly of the cleaning device, is then effected at a later time without the gas-inlet casing having to be interfered with again for this purpose.

In addition, the inner casing wall has a hollow interior space and is connected to the outer casing wall via at least one rib formed in the flow passage. The second line section runs in the interior of the rib and extends right into the interior space of the inner casing wall. To this end, it is integrally cast in the axial gas-inlet casing. The nozzle is fastened to the upstream end of the inner casing wall and is connected to the second line section. With this arrangement of the second line section, influencing of the exhaust-gas flow by the cleaning-agent feed line is avoided and the service life of the latter is substantially increased. The second line section requires little construction space, so that the gas-inlet casing can be designed to be relatively short in the axial direction. Furthermore, additional production outlay for the cleaning device is scarcely necessary during the manufacture of such an axial gas-inlet casing.

As an alternative to this, i.e. in the case of a radial gas-inlet casing, the second line section merges at its one end into a nozzle and extends at its other end from inside up to the inner casing wall. The inner casing wall has a fastening element for the second line section. A recess, adjoining which are both the first and the second line section, is made in the interior of the rib. After the turbocharger has been dismantled from the radial gas-inlet casing, the second line section, including the nozzle, can be released from the interior space of the inner casing wall relatively easily. It can therefore be exchanged separately, which results in a distinct reduction in costs.

Finally, the second line section is arranged upstream of the nozzle. This offers an additional design variant in which the second line section and the nozzle can be assembled and dismantled from outside. Requisite maintenance and repair work on the cleaning device can therefore be carried out substantially more quickly, so that the downtime of the turbocharger and thus also the downtime of the internal combustion engine can be reduced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a radial or an axial gas-inlet casing of an axial turbine, wherein.

Figure 1:
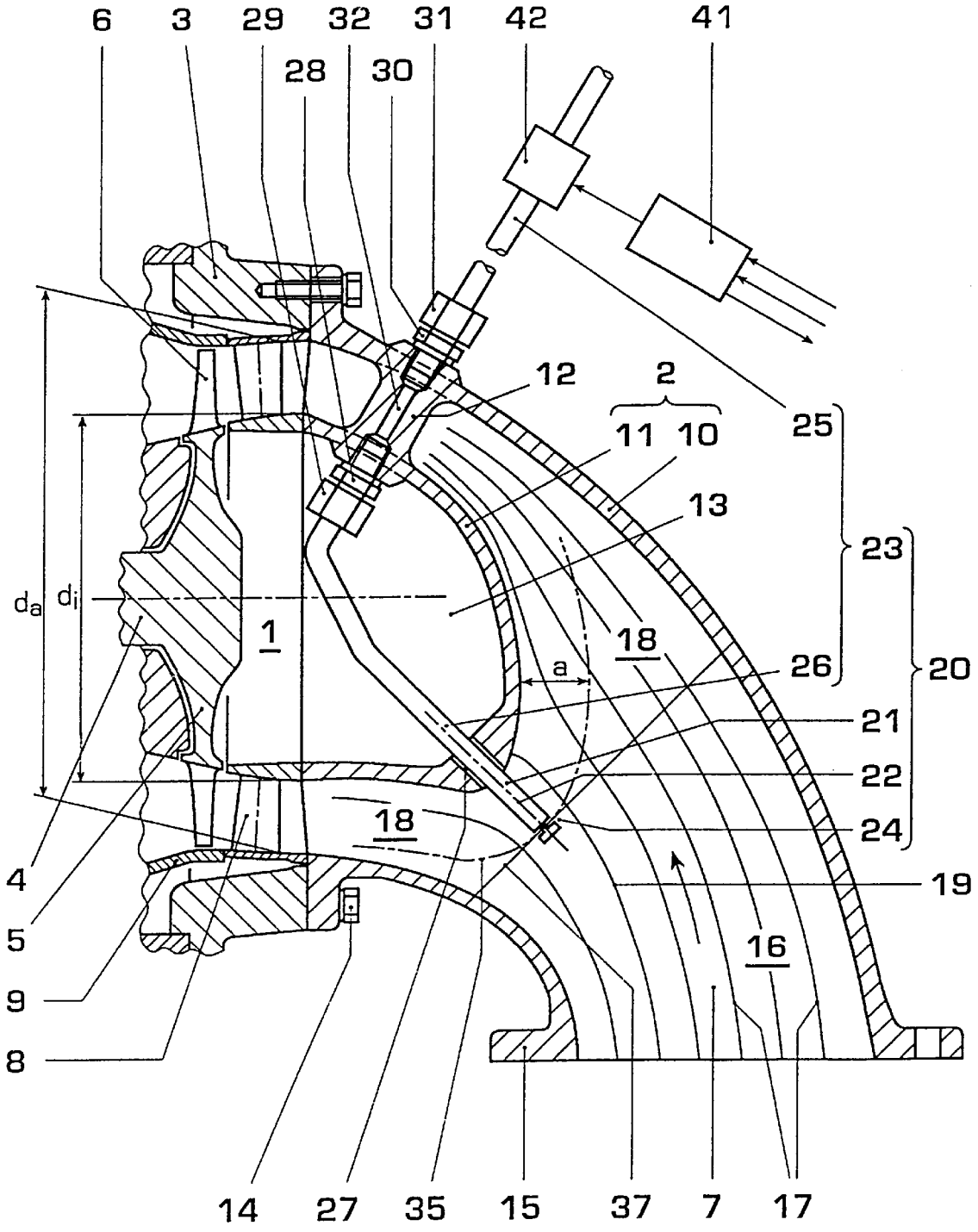
FIG. 1 shows a partial longitudinal section of the axial turbine equipped with a radial gas-inlet casing, shown in the plane of the stagnation-point flow line, i.e. in a plane accommodating all points of the stagnation-point flow line.

Only the elements essential for understanding the invention are shown. Elements of the plant which are not shown are, for example, the internal combustion engine and the compressor side as well as the bearing region of the turbocharger. The direction of flow of the working media is designated by arrows.

DESCRIPTION OF THE PREFERRED EMBODIMENTS

Referring now to the drawings, wherein like reference numerals designate identical or corresponding parts throughout the several views, the main parts of a turbocharger, only partly shown, are its compressor side and the turbine side equipped with an axial turbine 1. The turbocharger is connected on both the compressor and turbine side to an internal combustion engine designed as a diesel engine.

In a first exemplary embodiment, the axial turbine 1 is equipped with a radial gas-inlet casing 2. In addition, it has a gas-outlet casing 3, a turbine wheel 5 carried by a turbocharger shaft 4 and having moving blades 6, and a flow passage 7, formed in the gas-inlet casing 2, for the exhaust gases of the diesel engine. Arranged upstream of the moving blades 6 in the flow passage 7 is a nozzle ring 8 having an outside and an inside diameter $d_a$, $d_i$. The moving blades 6 are closed off to the outside by a cover ring 9 designed as a diffuser. The gas-inlet casing 2 has an outer and an inner casing wall 10, 11 which define the flow passage 7 and are connected to one another by three ribs 12 of fluidically favorable design, of which only one is shown. The inner casing wall 11 has a hollow interior space 13 and serves to cover the turbine wheel 5 and the turbocharger shaft 4 relative to the flow passage 7. A plurality of connecting elements 14 designed as screws for the gas-outlet casing 3 are arranged on the gas-inlet casing 2 (FIG. 1). At its upstream end, the gas-inlet casing 2 has a gas-inlet flange 15 used for connecting to an exhaust-gas pipe (not shown) of the diesel engine.

During operation of the turbocharger, the hot exhaust gases coming from the diesel engine are first of all directed in an exhaust-gas flow 16 of at least approximately circular cross section along a number of flow lines 17 into the radial gas-inlet casing 2 of the axial turbine 1. By the action of the inner casing wall 11, the exhaust-gas flow 16 is transformed into an annular exhaust-gas flow 18 having a single stagnation-point flow line 19 striking the inner casing wall 11 at right angles. The now annular exhaust-gas flow 18 is directed further to the turbine wheel 5 via the flow passage 7. In the process, the task of the nozzle ring 8 arranged upstream is to direct the exhaust gases onto the moving blades 6 of the turbine wheel 5 in an optimum manner. The turbine wheel 5 which is therefore driven provides in turn for the drive of the compressor (not shown) connected to it. The air compressed in the compressor is used for charging the diesel engine, i.e. for increasing the output of the latter.

Upstream of the nozzle ring 8, a cleaning device 20 leading into the flow passage 7 is arranged on the gas-inlet casing 2. This cleaning device 20 comprises a nozzle 21 having a center axis 22, a cleaning-agent feed line 23 and an injection opening 24. The cleaning-agent feed line 23 is of two-piece design, having a first and a second line section 25, 26. The latter is arranged almost exclusively in the interior space 13 of the inner casing wall 11. The upstream end of the inner casing wall 11 is provided with a bore 27. The second line section 26 leads through this bore 27 right into the flow passage 7, where it merges into the nozzle 21.

At its other end, the second line section 26 is attached in the region of one of the ribs 12 to the inner casing wall 11, for which purpose the latter is provided with a fastening element 28 designed as a screwed socket and the second line section 26 has a corresponding union nut 29. The first line section 25 engages from outside on the outer casing wall 10, for which purpose the latter likewise has a fastening element 30 designed as a screwed socket and the first line section 25 has a corresponding union nut 31. A recess 32 corresponding with the line sections 25, 26 is formed inside the relevant rib 12, i.e. between the first and the second line section 25, 26 (FIG. 1). Other fastening elements for the two line sections 25, 26 may of course also be provided.

The injection opening 24 of the nozzle 21 is arranged at the center 33 of an imaginary circular area 34. The circular area 34 is defined by the center 33 arranged at a distance a upstream of the inner casing wall 11 and by a diameter $d_k$. The center 33 of the circular area 34 lies on an imaginary parallel area 35 relative to the casing wall 11, the distance a of which from the inner casing wall 11 is calculated according to the following formula:

$$a = \frac{d_a + d_i}{2} \cdot P_1 \text{ with } 15\% \le P_1 \le 20\%$$

Figure 2:
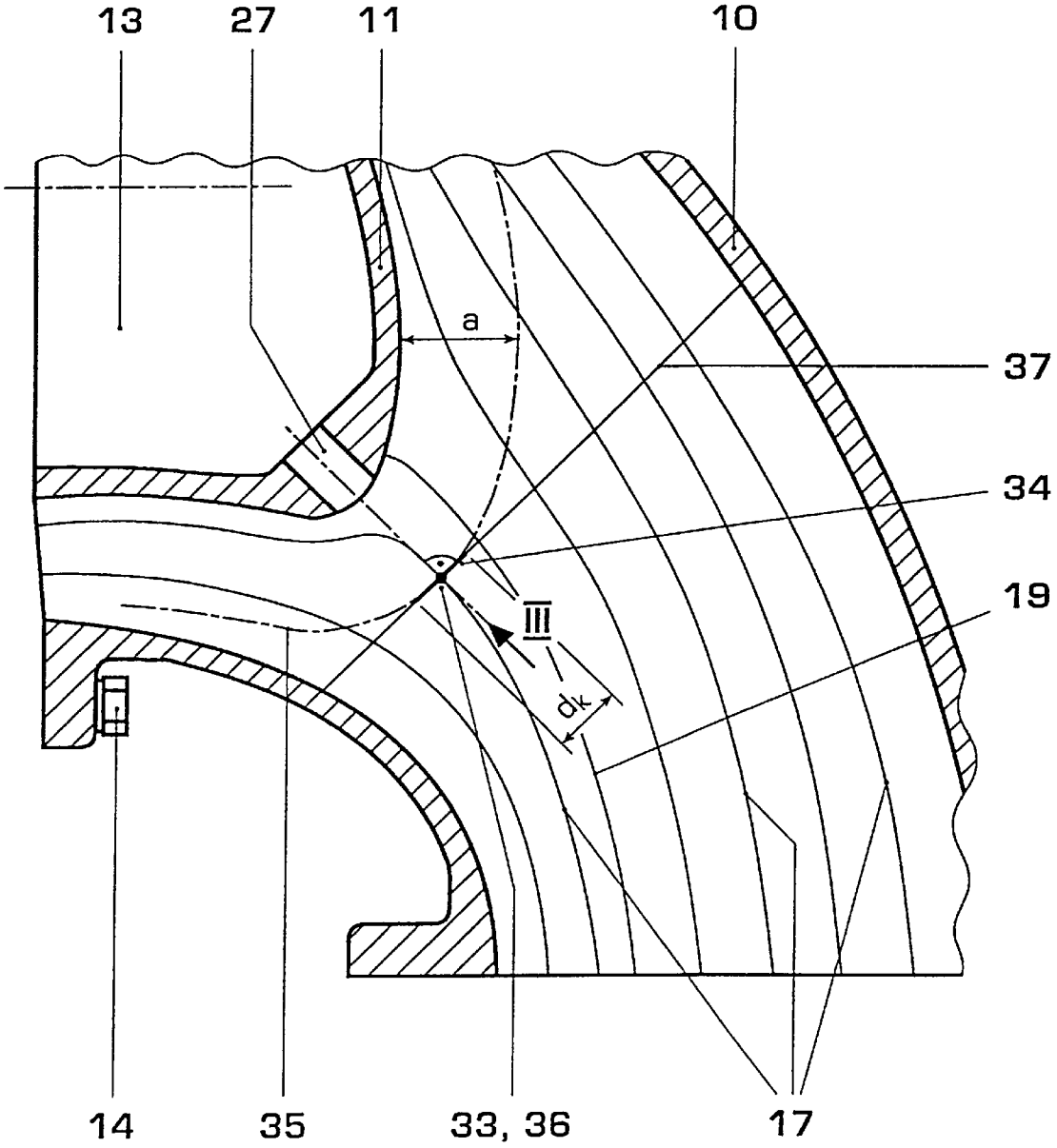
FIG. 2 shows an enlarged detail of FIG. 1 with the particulars required to localize the outlet opening of the nozzle.

The calculation of the location at which the injection opening 24 is to be arranged takes place before the nozzle 21 is installed in the gas-inlet casing 2. The corresponding procedure is shown in FIG. 2. According to the determination of the distance a described above, the percentage Pi results in a minimum and a maximum distance a of the parallel area 35 from the inner casing wall 11, the average value being shown in FIG. 2. Only one of the flow lines 17 of the exhaust-gas flow 16 which are present in a gas-inlet casing 2 formed without the nozzle 21 intersects the parallel area 35 at right angles and thus defines an intersection point 36 at which the center 33 of the circular area 34 is arranged. A tangential plane 37, in which the circular area 34 is formed, runs through the intersection point 36 and tangentially to the parallel area 35. The diameter $d_k$ of the circular area 34 is calculated according to the following formula:

$$d_k = \frac{d_a + d_i}{2} \cdot P_2 \text{ with } 0\% \le P_2 \le 6\%$$

Figure 3:
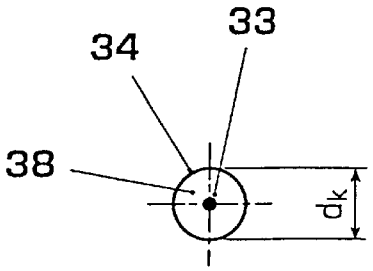
FIG. 3 shows a view of the imaginary circular area in the direction of arrow III in FIG. 2.

The center axis 22 of the nozzle 21 is arranged perpendicularly to the tangential plane 37 and its injection opening 24 is oriented parallel to the tangential plane 37. Although the injection opening 24 of the nozzle 21 in this exemplary embodiment lies at the center 33 of the circular area 34 (FIG. 1, FIG. 2), it may of course also be arranged at any other point 38 of the circular area 34 (FIG. 3). In this case, however, certain curtailments in the cleaning effect will have to be accepted.

Figure 4:
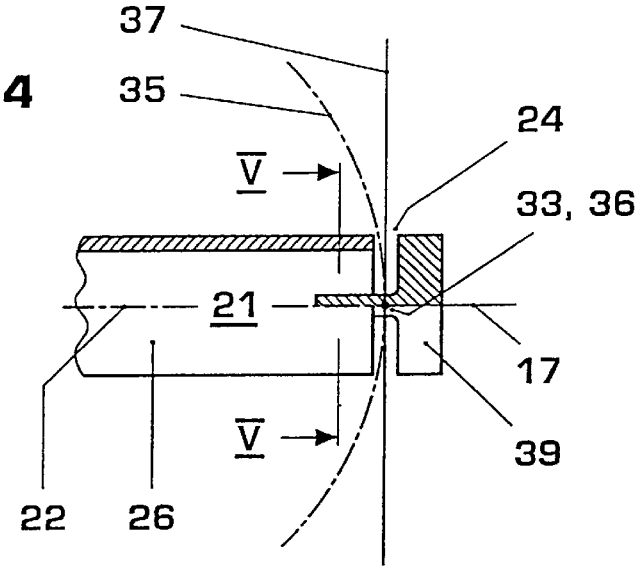
FIG. 4 shows an enlarged representation of the nozzle shown in FIG. 1, but only in cut-away section above the nozzle axis.
Figure 5:
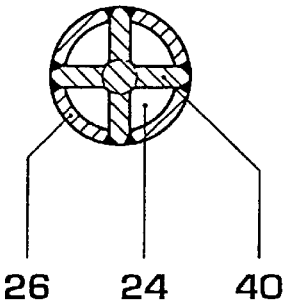
FIG. 5 shows a cross section through the nozzle along line V—V in FIG. 4.

To illustrate the arrangement of the injection opening 24, FIG. 4 shows an enlarged representation of the nozzle 21 with the intersection point 36 between the flow line 17 and the parallel area 35. Here, the tangential plane 37 runs centrally through the injection opening 24 and intersects the center axis 22 of the nozzle 21 at right angles. The nozzle 21 used for this purpose consists of the end of the second line section 26 and a baffle plate 29 having four fastening ribs 40 which are arranged in a cross shape and are welded to the line section 26 (FIG. 5). Other suitable nozzles may of course also be used.

The nozzle 21 and its injection opening 24 are thus arranged in a region of the flow passage 7 in which both the path of the flow lines 17 and the flow-velocity profile permit a complete spread and therefore a uniform distribution of the cleaning agent over the nozzle ring 8 and the moving blades 6 of the turbine wheel 5. Therefore the nozzle ring 8 and the moving blades 6 can be uniformly swept with the cleaning agent over both their periphery and their blade height, so that an improved cleaning effect is achieved despite the use of only one nozzle 21.

Liquids, such as water for example, or even solid substances, such as the known cleaning granules for example, may both be used as cleaning agent for the nozzle ring 8. However, the nozzle 21 described above is especially suitable for granules. The cleaning action is monitored by a measuring and control unit 41 connected to the cleaning device 20 and is initiated by means of a valve 42 (FIG. 1). The measuring and control unit 41 may, for example, be designed and arranged as in DE-A1 35 15 825. Other solutions are of course also possible. Thus, instead of the air pressure downstream of the turbocharger, another control variable, such as, for example, the exhaust-gas temperature, the charge pressure or the rotational speed of the turbocharger, can also be detected and a measuring element suitable for this purpose can be arranged. The unbalance resulting from the contamination of the turbine wheel can also be measured as turbocharger vibrations and can therefore likewise serve as a control variable.

Figure 8:
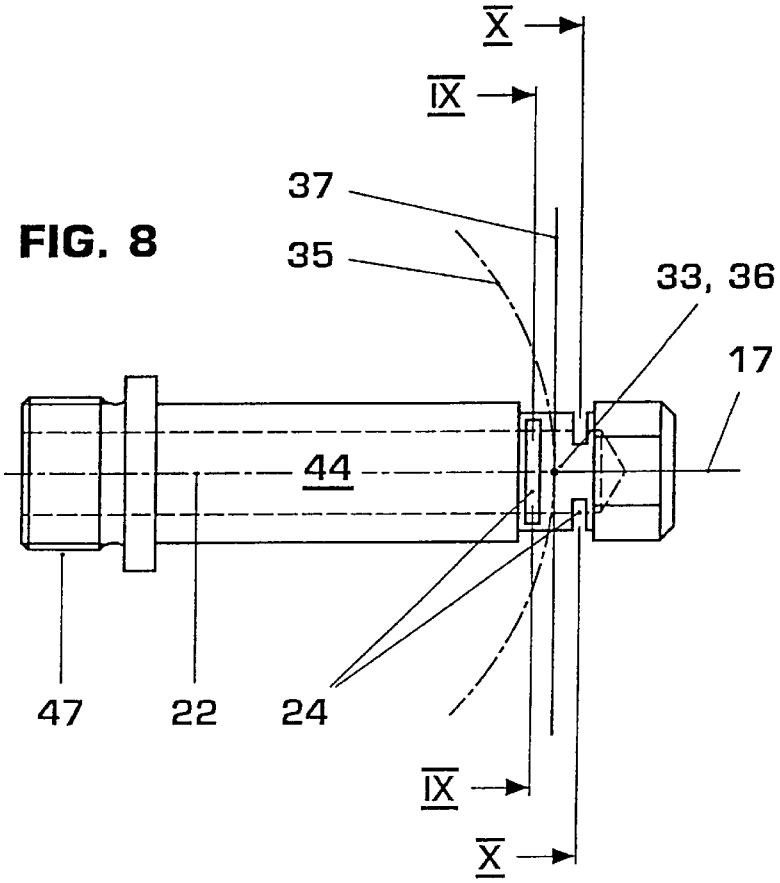
FIG. 8 shows an enlarged representation of the nozzle according to FIG. 6.
Figure 6:
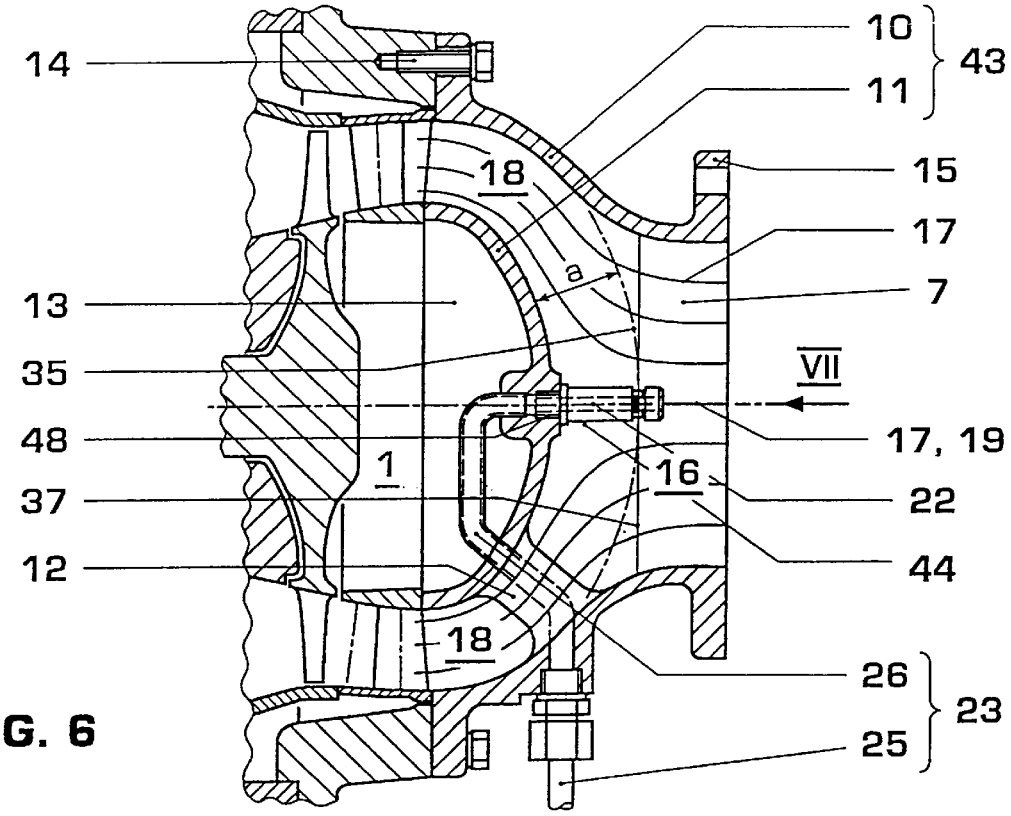
FIG. 6 shows a partial longitudinal section of the axial turbine equipped with an axial gas-inlet casing, shown in the plane of the stagnation-point flow line.
Figure 7:
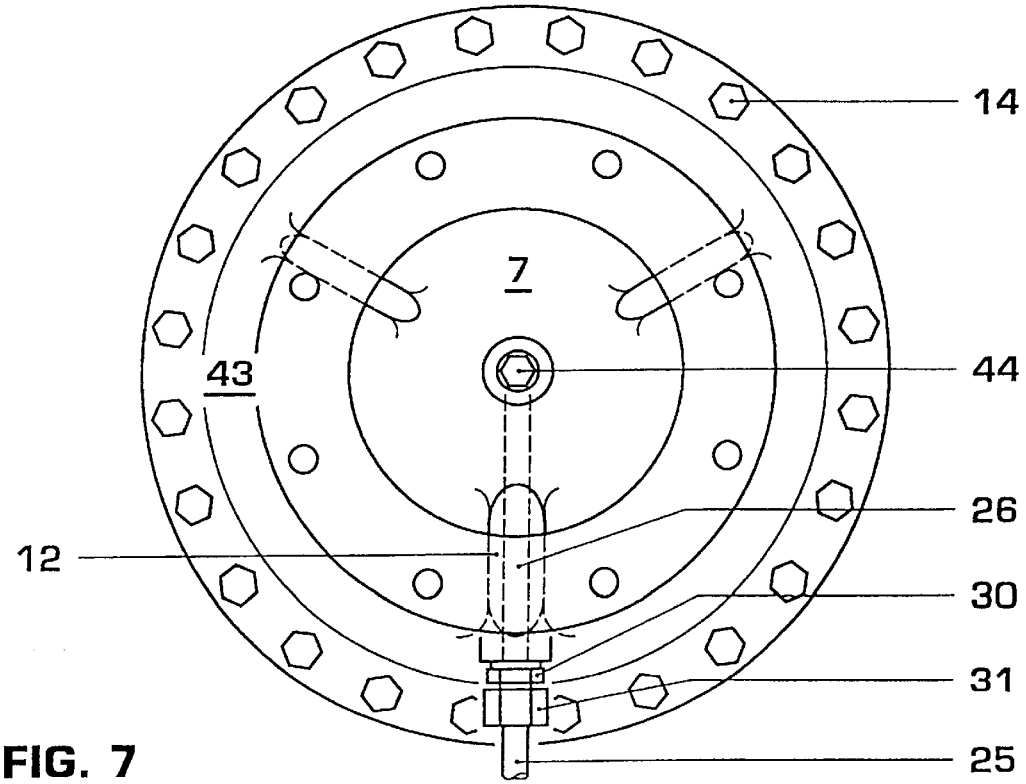
FIG. 7 shows a view of the gas-inlet casing according to FIG. 6 in arrow direction VII.

In a second exemplary embodiment, the turbocharger has an axial turbine 1 having an axial gas-inlet casing 43 (FIG. 6, FIG. 7). In this case, the second line section 26 of the cleaning-agent feed line 23 is integrally cast in the gas-inlet casing 43, i.e., to be more precise, in the inner casing wall 11, in one of the ribs 12 and in the outer casing wall 10. A nozzle 44 having four injection openings 24 is formed in the flow passage 7. On account of the central position of the stagnation-point flow line 19, there is no lateral displacement of the intersecting point 36, so that the latter and thus also the axis 22 of the nozzle 44 lie on the stagnation-point flow line 19 (FIG. 6). In a similar manner to the first exemplary embodiment, a circular area 34 may of course likewise be determined, in which case the injection openings 24 of the nozzle 44 may be arranged at any point 38 of this circular area 34 (FIG. 8, FIG. 3).

Figure 9:
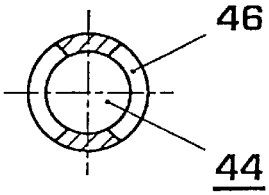
FIG. 9 shows a cross section through the nozzle along line IX—IX in FIG. 8.
Figure 10:
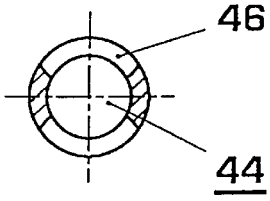
FIG. 10 shows cross section through the nozzle along line X—X in FIG. 8.

In each case two injection openings 24 of the nozzle 44 are arranged on both sides of the tangential plane 37 through the intersection point 36 and in each case at the same distance from this tangential plane 37. In this case, the injection openings 24 are arranged to overlap one another radially and are oriented parallel to the tangential plane 37 (FIG. 8). Each injection opening 24 has an injection area 46 (FIG. 9, FIG. 10), the sum of the injection areas 46 on both sides of the tangential plane 37 being of equal size. Made on the end of the nozzle 44 opposite the injection openings 24 is an external thread 47 (FIG. 8), which corresponds with an internal thread 48 of the inner casing wall 11 and serves to fasten the nozzle 44 (FIG. 6).

The nozzle 44 is especially suitable for the use of liquid cleaning agents, such as water for example. It is more cost-effective and also more robust compared with the nozzle 21 used in the first exemplary embodiment. The distribution of the cleaning agent and thus of the cleaning effect of both nozzles 44, 21 is identical.

Unlike the first exemplary embodiment, the second line section 26 is not only formed in the inner casing wall 11 but also leads through the rib 12. It leads out in the outer casing wall 10 and adjoins the first line section 25 there. To this end, the corresponding rib 12 must certainly be enlarged somewhat, but the screwed sockets 28 fastened to the inner casing wall 11 in the first exemplary embodiment and the corresponding union nuts 29 of the second line section 26 can be dispensed with (FIG. 1, FIG. 6). Therefore the second line section 26 cannot come loose in the interior space 13 of the inner casing wall 11, for which reason the risk of damage to the axial turbine 1 caused by the penetration of this line section 26 into the rotating turbine wheel 5 is ruled out.

Figure 11:
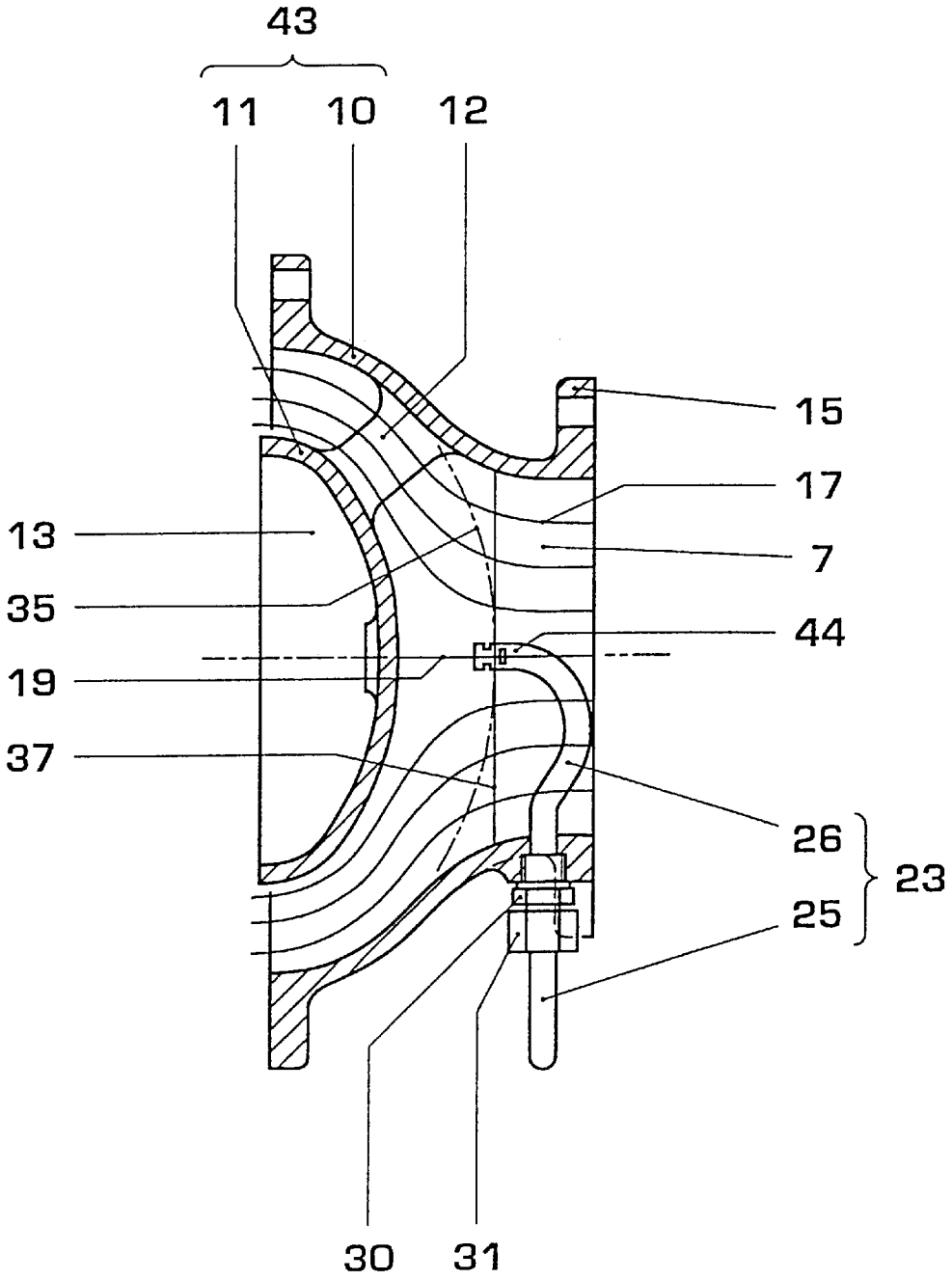
FIG. 11 shows a partial longitudinal section through a gas-inlet casing according to FIG. 6, but in a further embodiment.

In a third exemplary embodiment, again having an axial gas-inlet casing 43, the second line section 26 is arranged upstream of the nozzle 44 (FIG. 11). It therefore does not lead through the interior space 13 of the inner casing wall 11, for which reason the nozzle 44 is substantially simpler and in addition can be assembled or dismantled from outside. Such an arrangement is of course also possible in the case of a radial gas-inlet casing 2.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An axial turbine of a turbocharger, comprising:

a gas-inlet casing, a turbine wheel which is carried by a turbocharger shaft and has moving blades, a flow passage, formed in the gas-inlet casing, for exhaust gases of an internal combustion engine when connected to the turbocharger, a nozzle ring which is arranged upstream of the moving blades in the flow passage and has an outer diameter $d_a$ and an inner diameter $d_i$, and a cleaning device which is arranged further upstream of the nozzle ring, leads into the flow passage and is connected to a measuring and control unit, in which arrangement the gas-inlet casing has an outer and an inner casing wall, receives an exhaust-gas flow when connected to the internal combustion engine, the exhaust-gas flow being provided with a number of flow lines, and directs this exhaust-gas flow further to the moving blades of the turbine wheel;

the cleaning device comprises only one nozzle having a center axis and at least one injection opening as well as a cleaning-agent feed line;

the at least one injection opening is arranged at any point of an imaginary circular area, and the circular area is defined by a center arranged at a distance A upstream of the inner casing wall as well as by a diameter $d_k$;

the center of the circular area lies on an imaginary parallel area relative to the inner casing wall, the distance A of which from the inner casing wall is calculated according to the formula:

$$A = \frac{d_a + d_i}{2} \cdot P_1 \text{ with } 5\% \le P_1 \le 30\%;$$

one of the flow lines of the exhaust-gas flow, which flow lines can be represented in a gas-inlet casing formed without a nozzle, intersects the parallel area at right angles and thus defines an intersection point, at which the center of the circular area is arranged;

a tangential plane relative to the parallel area runs through the intersection point, and the circular area is formed in the tangential plane;

the diameter $d_k$ of the circular area is calculated according to the formula:

$$d_k = \frac{da + di}{2} \cdot P2 \text{ with } 0\% \le P_2 \le 6\%;$$

the center axis of the nozzle is arranged perpendicularly to the tangential plane, and the at least one injection opening of the nozzle is oriented at least approximately parallel to the tangential plane.

2. The axial turbine as claimed in claim 1, wherein $$15\% \le P_1 \le 20\%$$

and the nozzle has the at least one injection opening arranged at the center of the circular area.

3. The axial turbine as claimed in claim 1 wherein the nozzle has at least one injection opening on both sides of and at the same distance from the tangential plane;

the injection openings are arranged so as to overlap one another radially or at least adjoin one another;

each injection opening has an injection area and the sum of the injection areas on both sides of the tangential plane is the same size.

4. The axial turbine as claimed in claim 1, wherein the cleaning-agent feed line comprises two line sections;

a fastening element for the first line section adjoining from outside the outer casing wall is arranged on the outer casing wall;

the second line section is formed in the interior of the gas-inlet casing.

5. The axial turbine as claimed in claim 4, wherein the inner casing wall has a hollow interior space and is connected to the outer casing wall via at least one rib formed in the flow passage;

the second line section runs in the interior of the at least one rib, extends right into the interior space of the inner casing wall and is connected at its upstream end to the nozzle.

6. The axial turbine as claimed in claim 5, wherein the second line section is integrally cast in the gas-inlet casing, and the nozzle is fastened to the inner casing wall.

7. The axial turbine as claimed in claim 4, wherein the inner casing wall has a hollow interior space and is connected to the outer casing wall via at least one rib formed in the flow passage;

the second line section merges at its one end into the nozzle and extends at its other end from inside the inner casing wall up to the inner casing wall;

the inner casing wall has a fastening element for the second line section; and a recess, adjoining which are both the first and the second line section, is formed in the interior of the rib.

8. The axial turbine as claimed in claim 4, wherein the second line section is arranged upstream of the nozzle.

* * * * *